US005298951A

United States Patent [19]

Kai

[11] Patent Number: 5,298,951

[45] Date of Patent: Mar. 29, 1994

[54] IMAGE FORMING APPARATUS WITH TONER MONITORING SYSTEM

[75] Inventor: Masami Kai, Kashihara, Japan

[73] Assignee: Mita Industrial Co., Ltd., Osaka, Japan

[21] Appl. No.: 981,549

[22] Filed: Nov. 25, 1992

[30] Foreign Application Priority Data

Nov. 29, 1991 [JP] Japan ..... 3-342484

[51] Int. Cl.[5] ..... G03G 15/08

[52] U.S. Cl. ..... 355/260; 118/653; 118/689; 222/DIG. 1

[58] Field of Search ..... 355/260, 259, 245, 246, 355/327, 253; 118/645, 653, 656, 657, 689; 222/DIG. 1

[56] References Cited

U.S. PATENT DOCUMENTS 4,932,356 6/1990 Watanabe et al. ..... 118/689
4,937,626 6/1990 Kohtani et al. ..... 355/245
5,045,884 9/1991 Ohira et al. ..... 355/245

FOREIGN PATENT DOCUMENTS 0383160 8/1990 European Pat. Off. .
0488146 6/1992 European Pat. Off. .
60-176070 9/1985 Japan .
64-31172 1/1989 Japan .
2-162376 6/1990 Japan .

*Primary Examiner*—R. L. Moses
*Attorney, Agent, or Firm*—Renner, Otto, Boisselle & Sklar

[57] ABSTRACT

In an image forming apparatus, a toner container is provided for stocking a toner. In a body of the image forming apparatus, an opening is provided for supplying the toner to the toner container, and an opening cover for closing the opening when the toner is not supplied to the toner container. In the toner container, a rotator is provided so as to discharge the toner from the toner container into a developing device via a toner feed device. Moreover, the image forming apparatus includes an opening cover detector and a control section. The opening cover detector detects whether the opening cover is opened, and the control section prevents the rotator from driving when the opening cover detector detects that the opening cover is opened.

12 Claims, 5 Drawing Sheets

IMAGE FORMING APPARATUS WITH TONER MONITORING SYSTEM

BACKGROUND OF THE INVENTION

Field of the Invention

The present invention relates to an image forming apparatus such as a copying machine and printer.

Description of the Related Art

Generally in a copying machine, a toner is supplied to a toner container provided in the copying machine so as to stock the toner. Such a copying machine includes an opening for supplying the toner to the toner container, and an opening cover for closing the opening. A user opens the opening cover so as to supply the toner to the toner container using a toner bottle. Alternatively, the user supplies the toner to the toner container by attaching a toner cartridge to the toner container.

In the toner container of the copying machine, a rotator is provided for feeding the toner from the toner container to a developing device. During a copying operation, the rotator is rotated so as to feed the toner to the developing device. Therefore, when the user opens the opening cover to supply the toner to the toner container, there is a possibility that the toner will be dispersed around the copying machine.

Therefore, hitherto, the following method has been employed: when the opening cover is opened so as to supply the toner to the toner container, a power source of the copying machine is turned off. And thus, when the toner is supplied to the toner container, the rotator stops rotating, thereby preventing the toner from being dispersed around the copying machine. However, this method has a disadvantage in that efficiency of the copying operation is reduced.

SUMMARY OF THE INVENTION

The image forming apparatus of the present invention, comprises:

- a toner container for stocking a toner to be fed to a developing device;
- a rotator provided in the toner container, for discharging the toner from the toner container;
- an opening provided in a body of the image forming apparatus, for supplying the toner to the toner container;
- an opening cover for closing the opening when the toner is not supplied to the toner container;
- an opening cover detector for detecting whether the opening cover is opened; and
- a control section for preventing the rotator from driving when the opening cover detector detects that the opening cover is opened.

Thus, the invention described herein makes possible the advantages of providing: (1) an image forming apparatus having no possibility that a toner will be dispersed around the image forming apparatus while the toner is supplied to a toner container; and (2) an image forming apparatus in which efficiency of an image forming operation does not reduced.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrating an embodiment referring to figures.

A multicolor developing apparatus 2 of a copying machine according to an embodiment of the present invention comprises a stationary frame and a mobile frame. The mobile frame is attached to the stationary frame so as to be reciprocated vertically along a guide rail by a transferring device. The guide rail and the transferring device are provided in the stationary frame. The stationary frame and mobile frame are each nearly rectangular.

Figure 1:
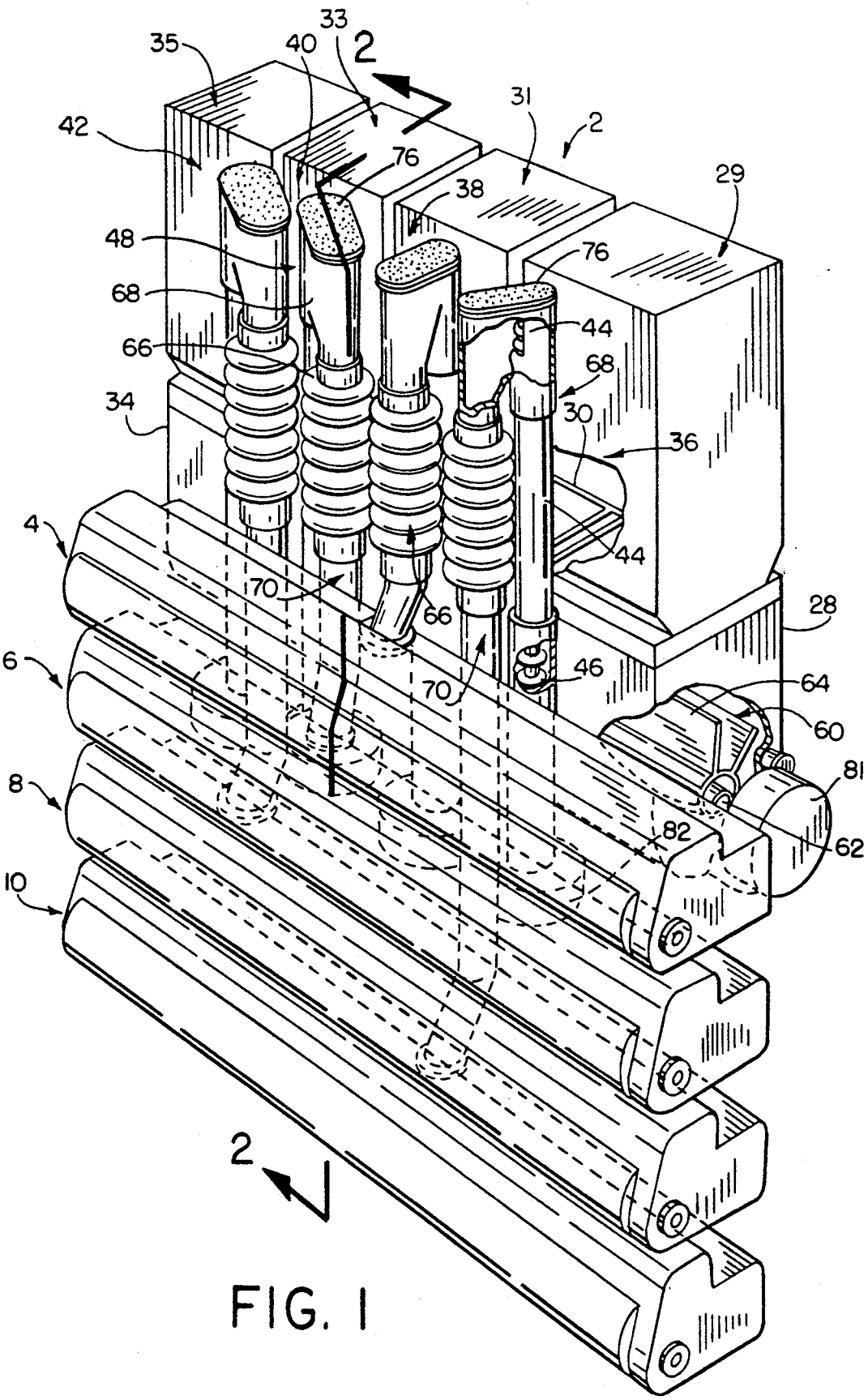
FIG. 1 is a perspective view showing a multicolor developing apparatus according to an embodiment of the present invention.

As shown in FIG. 1, the mobile frame is provided with four developing devices 4, 6, 8 and 10 which are arranged vertically in this order from above at prescribed intervals. A developer containing a cyan toner is accommodated in the developing device 4. A developer containing a yellow toner is accommodated in the developing device 6. A developer containing a magenta toner is accommodated in the developing device 8. A developer containing a black toner is accommodated in the developing device 10. These developers each comprise a toner and carrier. The fundamental constitution of these developers are substantially the same with one another. Therefore, hereinafter the developing device according to the present embodiment will be described referring to the developing device 6.

Figure 2:
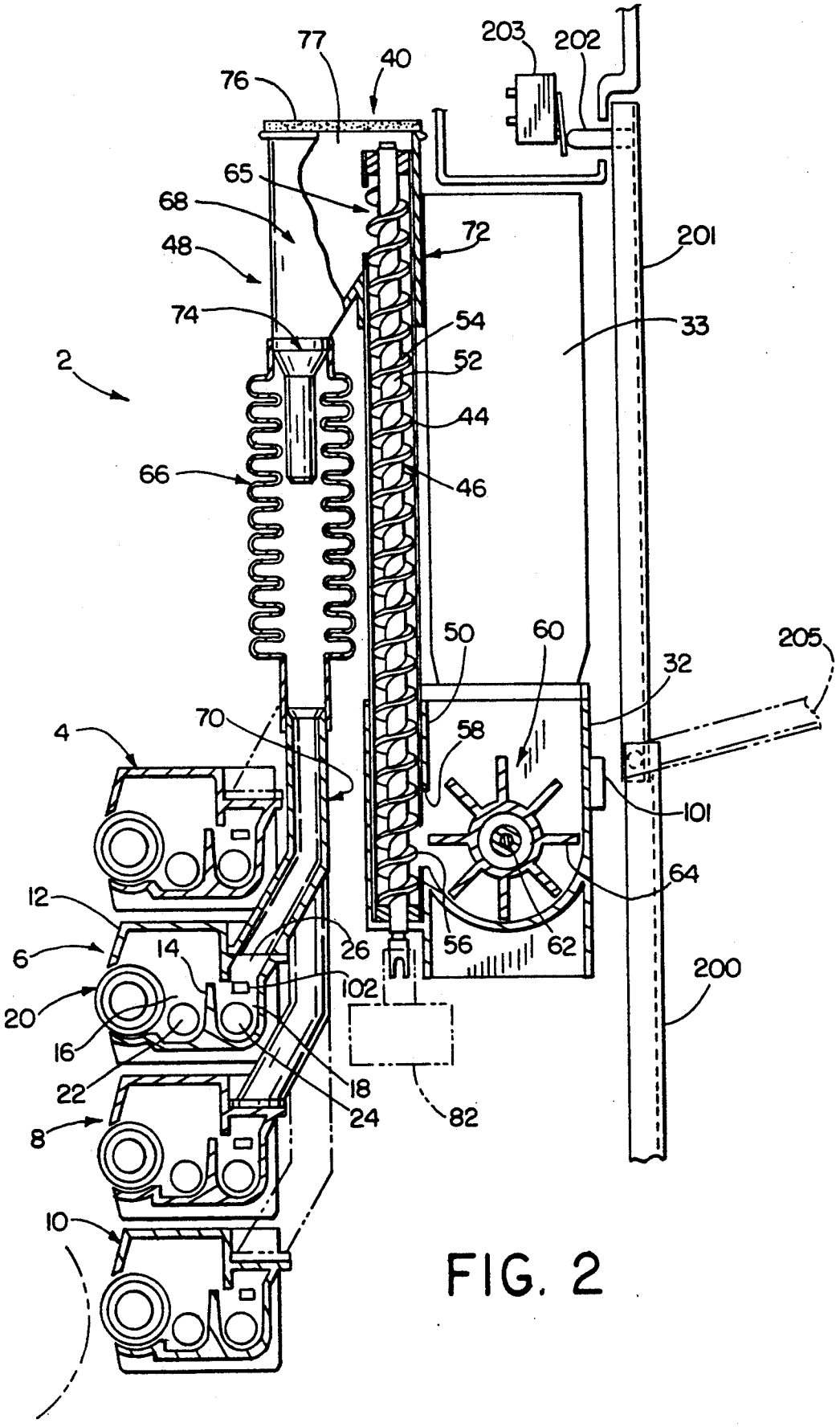
FIG. 2 is a cross-sectional view taken along line 22 of FIG. 1.

As shown in FIG. 2, the developing device 6 is provided with a developing housing 12. In the developing housing 12, two chambers 16 and 18 are formed by a partition wall 14 provided in the longitudinal direction of the developing housing 12. The chambers 16 and 18 are connected with each other by passageways (not shown) at each end of the partition wall 14. The chamber 16 is provided with a sleeve 20 and a spiral roller 22 for agitating the developer therein. The chamber 18 is provided with a spiral roller 24 for agitating the developer therein.

The sleeve 20 is rotatably supported by the developing housing 12 so that a part of the circumferential surface thereof may project from an opening provided along one side of the developing housing 12. When the developing device 6 is positioned in a prescribed developing position, the projected part of the circumferential surface of the sleeve 20 approaches to a developing position of a photosensitive drum (see two-dot dash line in FIG. 2) provided in the stationary frame so as to provide the toner thereto, and thus a developing operation is performed.

The spiral rollers 22 and 24 are rotatably provided in the chambers 16 and 18 respectively so as to extend in parallel with the longitudinal direction of the developing housing 12. The sleeve 20, and the spiral rollers 22 and 24 are each connected with a motor 83 (see FIG. 4) via a gear train (not shown), and constituted so as to rotate simultaneously. When the spiral rollers 22 and 24 rotate simultaneously, the developers in the chambers 16 and 18 are longitudinally transferred in an opposite direction from each other. Thus, the developer in the developing housing 12 is circulated while being agitated.

Above the chamber 18 of the developing housing 12, an opening 26 is provided for receiving the toner fed by a toner feed device 40 described later. The opening 26 is located in the upstream side of the spiral roller 24.

When the mobile frame is transferred by the transferring device, the developing devices 4, 6, 8, and 10 are each selectively positioned in prescribed developing positions, and thus a developing operation is performed with different colors by the developing devices 4, 6, 8, and 10.

As shown in FIG. 1, toner containers 28, 30, 32 and 34 are horizontally arranged at one side of the highest located developing device 4. The number of the toner containers 28, 30, 32, and 34 is congruent with the number of the developing devices 10, 4, 6, and 8. A black toner, cyan toner, yellow toner, and magenta toner are accommodated in the toner containers 28, 30, 32, and 34, respectively. These toner containers 28, 30, 32, and 34 are each attached to a support frame (not shown) provided in the stationary frame. Toner cartridges 29, 31, 33, and 35 are applied to the toner containers 28, 30, 32, and 34, respectively.

On one side wall 200 of the body of the copying machine, an opening 205 is provided for exchanging the toner cartridges 29, 31, 33, and 35, and an opening cover 201 is provided for closing the opening 205. Moreover, in the copying machine, an opening cover discriminating switch 203 is provided for discriminating whether the opening cover 201 is opened. An inner projection 202 is provided in the opening cover 201 so as to extend toward the inside of the copying machine. The inner projection 202 turns on the switch 203 when the opening cover 201 is closed. On the other hand, the inner projection 202 turns off the switch 203 when the opening cover 201 is opened.

As shown in FIG. 1, between the toner container 28 and the developing device 10 corresponding to the toner container 28, a toner feed device 36 is provided for feeding the toner from the toner container 28 to the developing device. 10. Between the toner container 30 and the developing device 4 corresponding to the toner container 30, a toner feed device 38 is provided for feeding the toner from the toner container 30 to the developing device 4. Between the toner container 32 and the developing device 6 corresponding to the toner container 32, a toner feed device 40 is provided for feeding the toner from the toner container 32 to the developing device 6. Between the toner container 34 and the developing device 8 corresponding to the toner container 34, a toner feed device 42 is provided for feeding the toner form the toner container 34 to the developing device 8.

The toner containers 28, 30, 32, and 34 have the same fundamental constitution with one another except the layout thereof. The toner feed devices 36, 38, 40, and 42 have the same fundamental constitution with one another except the layout thereof. Therefore, hereinafter the toner container and the toner feed device corresponding thereto according to the present embodiment will be described referring to the toner container 32 and the toner feed device 40.

The toner feed device 40 includes a cylindrical member 44 extending vertically upward from a bottom portion of the toner container 32; a spiral roller 46 extending along the cylindrical member 44 in the cylindrical member 44; and a passage 48 is provided so that the toner may be dropped therethrough. The spiral roller 46 transfers the toner discharged into the cylindrical member 44 from a lower portion of the toner container 32 to an upper portion of the cylindrical member 44. The passage 48, which is connected with the upper portion of the cylindrical member 44 and the developing device 6, feeds the developing device 6 with the toner transferred to the upper portion of the cylindrical member 44 by the spiral roller 46.

On the side of the toner container 32, toward the developing device 6, a cylindrical supporting member 50 is provided. A bottom portion of the cylindrical member 44 is inserted in and supported by the cylindrical supporting member 50. The spiral roller 46 comprises a shaft 52 which is rotatably supported by bearings provided in upper and lower edges of the cylindrical member 44; and a spiral member 54 provided in the shaft 52. The shaft 52 extends downward from the bottom portion of the cylindrical member 44 and is connected with a motor 82 as a drive source. The motor 82 is driven while the toner is fed to the developing device 6.

In a lower portion of the cylindrical member 44, an opening 56 is provided for receiving the toner. In the supporting member 50 provided in the toner container 32, an opening 58 is provided so as to correspond to the opening 56. In the toner container 32, a rotator 60 is provided for discharging the toner stocked in the toner container 32 into the lower portion of the cylindrical member 44.

The rotator 60 comprises a shaft 62 passing through the toner container 32, and a plurality of blades 64 provided in the shaft 62 radially. The rotator 60 is connected with a motor 81 (FIG. 1) as a drive source. The motor 81 cannot be driven while the opening cover 201 is opened, and it can be driven while the opening cover 201 is closed. The motor 81 is usually driven when a copying operation is performed, and when the toner is fed to the developing device 6. When the rotator 60 rotates, the toner in the toner container 32 is discharged into the lower portion of the cylindrical member 44 through the openings 58 and 56.

The passage 48 comprises bellows 66 as stretching means provided so as to extend along a substantially vertical direction, i.e., in a direction in which the developing device 6 moves. The passage 48 further comprises a housing 68 located between the upper edge of the cylindrical member 44 and an upper edge of the bellows 66 so as to drop the toner transferred to the upper portion of the cylindrical member 44 into the bellows 66; and a pipe 70 for connecting a lower edge of the bellows 66 with the developing device 6 and further dropping the toner which has been dropped into the bellows 66 into the developing device 6 so as to feed the toner thereto.

At an upper portion of the housing 68, a cylindrical section 72 is provided so as to extend vertically downward. The cylindrical section 72 is connected with the upper portion of the cylindrical member 44. At a lower edge of the housing 68, another cylindrical section 74 is provided so as to be connected with the upper edge of the bellows 66. At an upper edge of the housing 68, an opening 77 is provided for a draft. The opening 77 is covered with a filter 76 so as to prevent the toner from being discharged through the opening 77. At the upper portion of the cylindrical member 44, an opening 65 is provided for discharging the toner transferred by the spiral roller 46 into the housing 68.

In the above configuration, the mobile frame is reciprocated vertically by the transferring device in accordance with a copying operation. The developing devices 4, 6, 8, and 10 are each selectively positioned at prescribed developing positions, and thus a developing operation is performed with different colors by the developing devices 4, 6, 8 and 10. When the mobile frame is transferred by the transferring device so as to position the developing device 6 at the prescribed developing position, the sleeve 20, spiral rollers 22 and 24 of the developing device 6 are rotated by the motor 83 so as to apply the toner to the surface of the photosensitive drum, and thus the developing operation is performed.

On the other hand, while the toner is fed to the developing device 6, the motors 81, 82, and 83 are driven so as to rotate the rotator 60, and the spiral rollers 46, 22 and 24. Thus the toner stocked in the toner container 32 is discharged into the lower portion of the cylindrical member 44 by the rotator 60, and then transferred to the housing 68 by the spiral roller 46. The toner transferred to the housing 68 is fed to the chamber 18 of the developing housing 12 after dropping through the bellows 66 and the pipe 70. Then, the toner in the developing housing 12 is agitated by the spiral rollers 22 and 24.

When the prescribed developing operation by the developing device 6 is completed, the mobile frame begins to move so as to select one of the other developing devices 4, 8, and 10 and position it to a prescribed developing position. Then, the above-mentioned process will be repeated.

Hereinafter, a feeding operation of the multicolor developing apparatus 2 according to the present embodiment will be described referring to the toner container 32, and the toner feed device 40 and the developing device 6 corresponding thereto.

In the toner container 32, a toner volume detector 101 is provided for detecting whether the toner volume in the toner container 32 is reduced to a prescribed value. In the developing housing 12, a toner density detector 102 is provided for detecting the toner density in the developing device 6.

Figure 3:
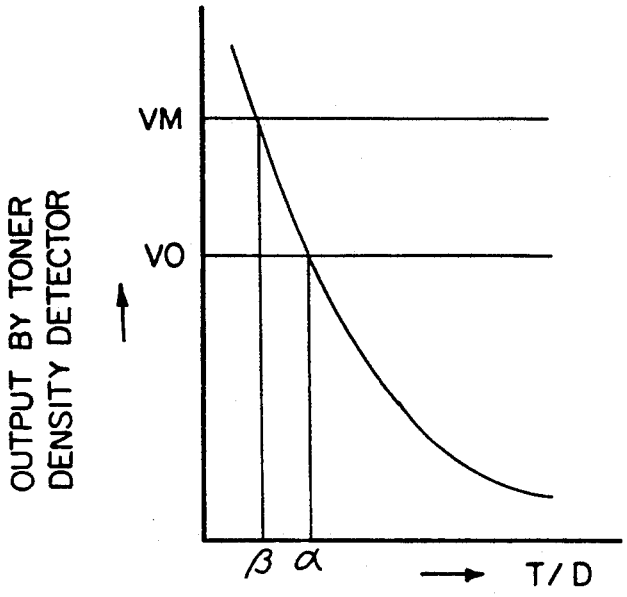
FIG. 3 is a graph showing an output characteristic of a toner density detector according to the embodiment of the present invention.

FIG. 3 shows an output characteristic of the toner density detector 102. The output of the toner density detector 102 is reduced as the toner density in the developing device 6 is increased. In FIG. 3, VO represents an output voltage of the toner density detector 102 at a control reference toner value $\alpha$. VM represents an output voltage of the toner density detector 102 at a toner value $\beta$. Herein, the toner value $\alpha$ is defined as the mean toner density of preferred toner densities, and the toner value $\beta$ is defined as the minimum toner density for allowing a copying operation, i.e., the copying operation should be stopped if the toner density is at below the toner value $\beta$.

Figure 4:
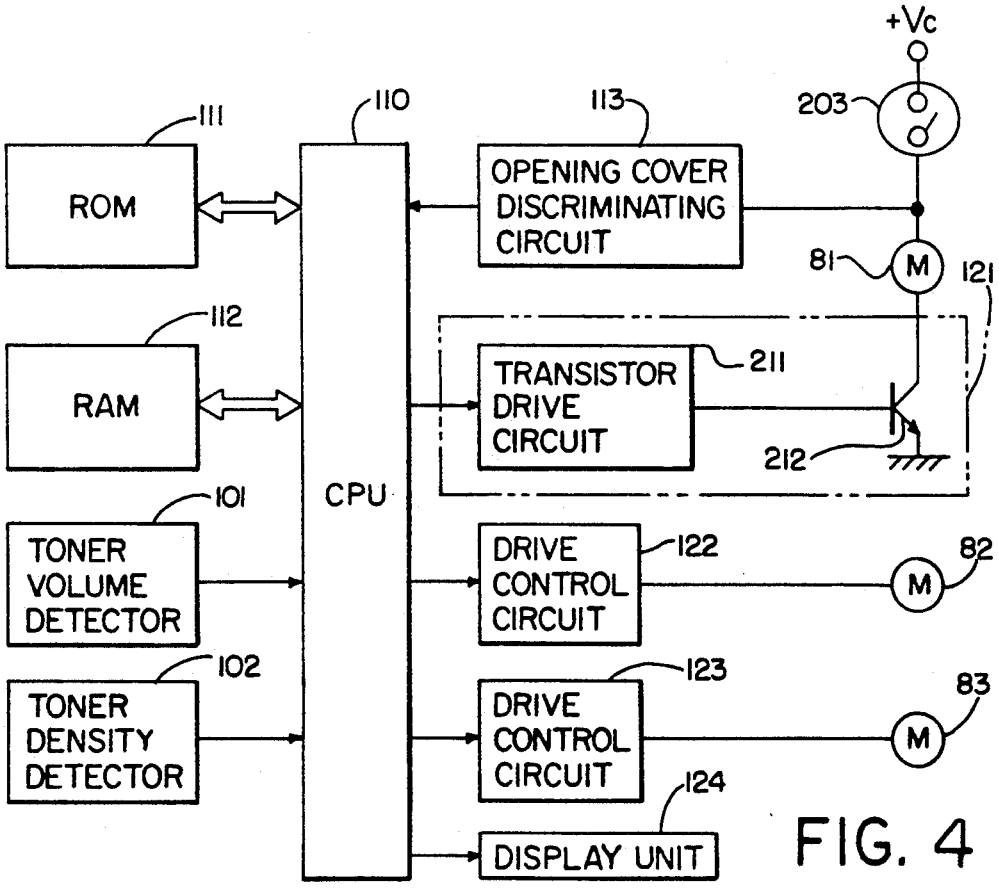
FIG. 4 is an electrical block diagram showing a control circuit according to the embodiment.

FIG. 4 shows a control circuit using a CPU 110 according to the present embodiment. The CPU 110 comprises a ROM 111 for recording a program of the CPU 110 and a RAM 112 for recording necessary data for the program.

The toner volume detector 101 and the toner density detector 102 each output a signal to the CPU 110. The CPU 110 outputs a signal to each of a control circuit 121 for the motor 81 for driving the rotator 60, a control circuit 122 for the motor 82 for driving the spiral roller 46; a control circuit 123 for the motor 83 for driving the spiral rollers 22 and 24; and a display unit 124.

The motor 81 is connected to a direct voltage source Vc via the opening cover discriminating switch 203; and the motor 81 is connected to the ground via a switching transistor 212. The switching transistor 212 and a transistor drive circuit 211 thereof constitute a drive control circuit 121 for the motor 81. Therefore, when the opening 201 is opened, the opening cover discriminating switch 203 is turned off, thereby preventing the motor 81 from driving. When the opening cover 201 is closed, the opening cover discriminating switch 203 is turned on, thereby enabling the motor 81 to drive.

The motor 81 and the opening cover discriminating switch 203 are each connected to an opening cover discriminating circuit 113. The opening cover discriminating circuit 113 discriminates whether the opening cover 201 is opened by the opening cover discriminating switch 203, and then outputs a signal to the CPU 110. Then, the CPU 110 discriminates whether the opening cover 201 is opened.

Figure 5:
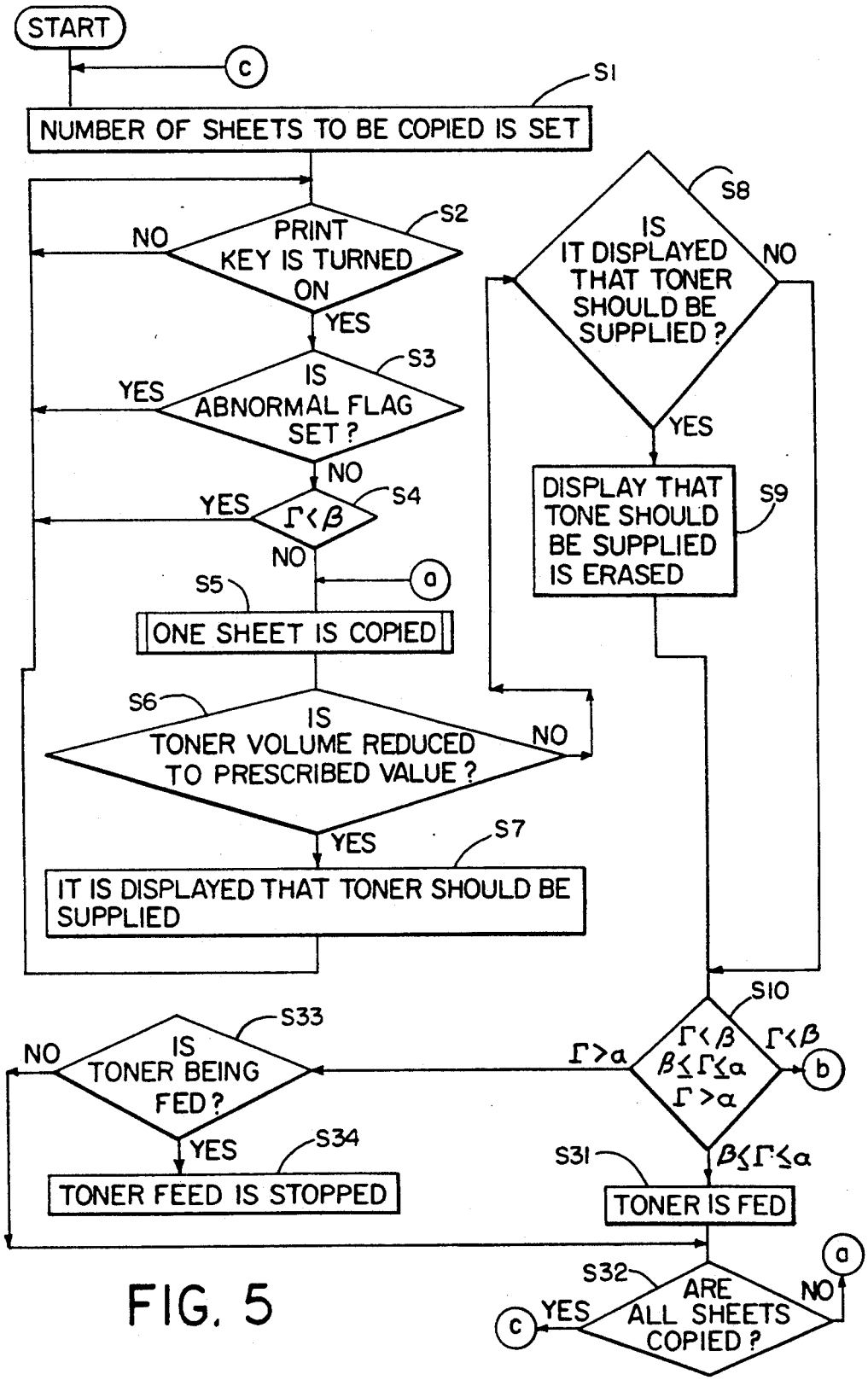
FIG. 5 is a flow chart according to the embodiment, continued to FIG. 6.
Figure 6:
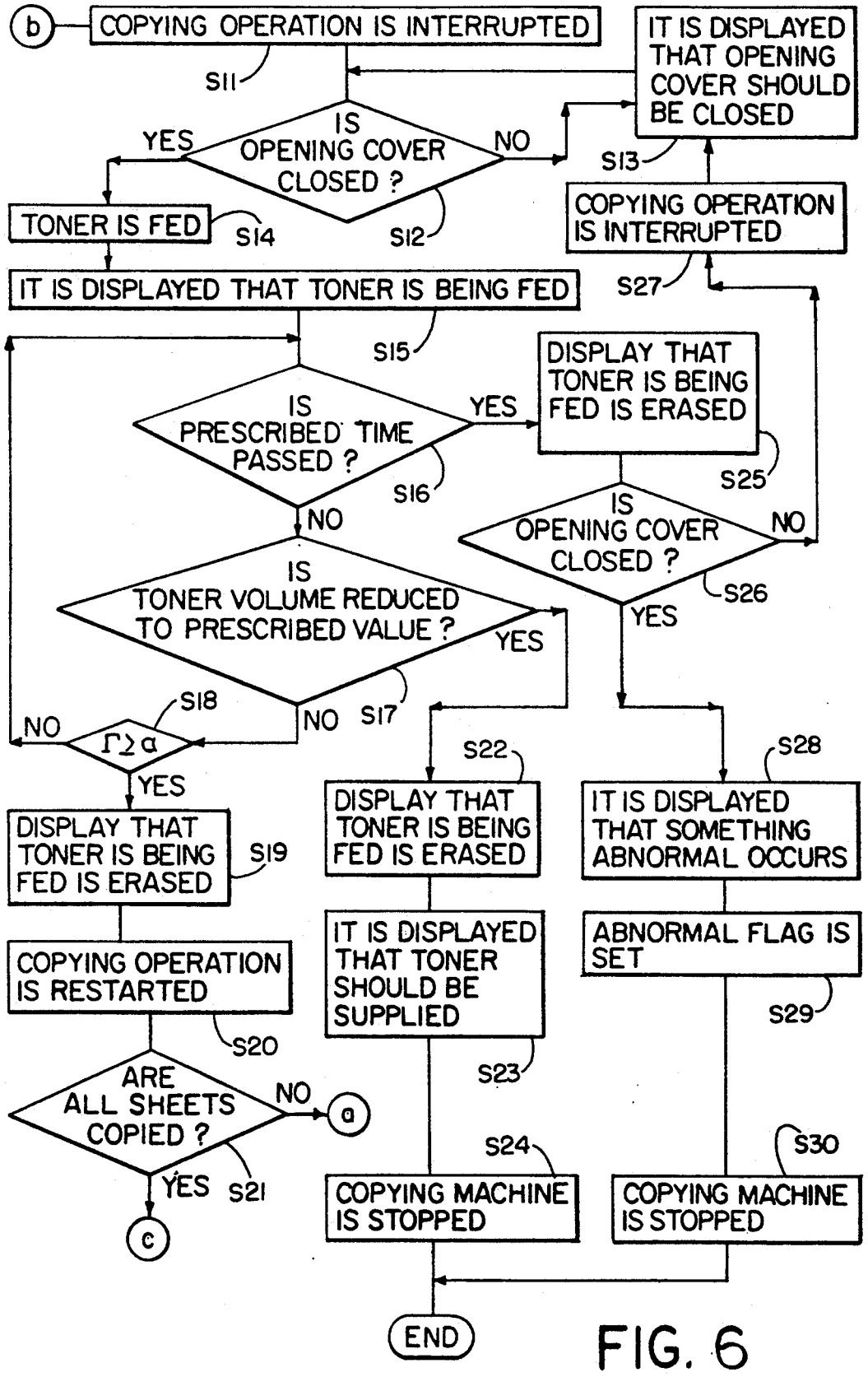
FIG. 6 is a flow chart continued from FIG. 5.

Next, a program according to the present embodiment will be described referring to flow charts in FIGS. 5 and 6.

After the copying machine is turned on, a number of sheets to be copied is set (step S1); a print key is turned on (step S2); and the CPU 110 discriminates whether an abnormal flag described later is set (step S3). If the abnormal flag is set, the program is returned to step S2, and thus the copying operation is prevented.

If the abnormal flag is not set, the toner density detector 102 detects whether the toner density $\Gamma$ is at below the toner value $\beta$ (step S4). If the toner density $\Gamma$ is at below the toner density $\beta$ ($\Gamma<\beta$), the program is returned to step S2, and thus the copying operation is prevented.

If the toner density $\Gamma$ is at the toner value $\beta$ or above, one sheet is copied (step S5). Then the toner volume detector 101 detects whether the toner volume in the toner container 32 is reduced to the prescribed value (step S6). If the toner volume in the toner container 32 is reduced to the prescribed value, the display unit 124 displays that the toner should be supplied to the toner container 32 (step S7), and then the program is returned to step S2.

If the opening cover 201 is opened so as to exchange the toner cartridge 33 for a new cartridge, the opening cover discriminating switch 203 is turned off, and thus the motor 81 is prevented from driving. Therefore, while the opening cover 201 is opened, the rotator 60 is prevented from rotating, and thus there is no possibility that the toner will be dispersed around the copying machine while the toner cartridge 33 is exchanged for the new cartridge.

If the toner volume detector 101 detects that the toner volume in the toner container 32 is reduced to the prescribed value at step S6, steps S2 through S7 will be repeated until the toner cartridge 33 is exchanged for the new cartridge and the toner volume detector 101 detects that the toner volume in the toner container 32 exceeds the prescribed value. Therefore, while steps S2 through S7 are repeated, the successive copying operation is prevented even if a number of a plurality of sheets to be copied has been set. However, it is possible to copy one sheet by operating the print key. That is to say, even if the opening cover 201 is opened, only the motor 81 is prevented from driving. Therefore, one sheet can be copied by operating the print key even if the opening cover 201 is opened.

If the toner volume detector 101 detects that the toner volume in the toner container 32 exceeds the prescribed value at step S6, the CPU 110 discriminates whether the display unit 124 displays that the toner should be supplied to the toner container 32 (step S8). If it is displayed that the toner should be supplied, the display is erased (step S9), and then the toner density detector 102 detects whether the toner density $\Gamma$ is at below the toner value $\beta$ ($\Gamma<\beta$); between the toner value $\beta$ and the control reference toner value $\alpha$ ($\beta\leqq\Gamma\leqq\alpha$); or above the control reference toner value $\alpha$ ($\Gamma>\alpha$) (step S10).

If the display unit 124 does not display that the toner should be supplied to the toner container 32 at step S8, the program proceeds to step S10 where the toner density detector 102 detects whether the toner density $\Gamma$ is at below the toner value $\beta$ ($\Gamma<\beta$); between the toner value $\beta$ and the control reference toner value $\alpha$ ($\beta\leqq\Gamma\leqq\alpha$); or above the control reference toner value $\alpha$ ($\Gamma>\alpha$).

If the toner density detector 102 detects that the toner density $\Gamma$ is at below the toner value $\beta$ ($\Gamma<B$) at step S10, the copying operation is interrupted so as to supply the toner to the toner container 32 (step S11). This occurs in the following case: even after the toner volume in the toner container 32 was reduced to the prescribed value, the copying operation has been continued without exchanging the toner cartridge 33 for a new one until the toner in the cylindrical member 44 is exhausted.

In order to feed the toner to the developing device 6, the opening cover 201 should be closed so as to rotate the rotator 60. Therefore, if the copying operation is interrupted at step S11, the CPU 110 discriminates whether the opening cover 201 is closed (step S12). If the opening cover 201 is opened, the display unit 124 displays that the opening cover 201 should be closed (step S13). If the opening cover 201 is closed or if the opening cover 201 is put into a closed state, the toner is fed to the developing device 6 (step S14).

In order to feed the toner to the developing device 6, the motors 81, 82, and 83 are driven so as to rotate the rotator 60, and the spiral rollers 46, 22, and 24. While the toner is fed to the developing device 6, the display unit 124 displays that the toner is being fed (step S15). If the display unit 124 displays that the opening cover 201 should be closed, the display is changed into one showing that the toner is being fed.

The CPU 110 discriminates whether a prescribed time (e.g. two minutes) has been passed since the toner began to be fed to the developing device 6 (step S16). If the prescribed time has not been passed, the toner volume detector 101 detects whether the toner volume in the toner container 32 is reduced to the prescribed value (step S17). If the toner volume in the toner container 32 exceeds the prescribed value, the toner density detector 102 detects whether the toner density $\Gamma$ is at the control reference toner value $\alpha$ or above (step S18). If the toner density $\Gamma$ is at below the control reference toner value $\alpha$ ($\Gamma<\alpha$), the program is returned to step S16, and then steps S16 through S18 will be repeated.

At step S18, if the toner density $\Gamma$ is at the control reference toner value $\alpha$ or above ($\Gamma\geqq\alpha$), the display that the toner is being fed is erased (step S19), and then the coping operating is restarted (step S20). Then, the CPU 110 discriminates whether the copying operation of all the sheets to be copied has been completed (step S21). If the copying operation of all the sheets to be copied has not been completed yet, the program is returned to step S5 where one of the remaining sheets to be copied is copied. On the other hand, if the copying operation of all the sheets to be copied has been completed (step S21), the program is returned to step S1.

If the toner volume detector 101 detects that the toner volume in the toner container 32 is reduced to the prescribed value at step S17, the display that the toner is being fed is erased (step S22), and it is displayed that the toner should be supplied to the toner container 32 (step S23). Then, the copying machine is stopped (step S24), and thus the program is completed. In this case, after the user exchanges the toner cartridge 33 for the new cartridge so as to supply the toner to the toner container 32, the copying machine returns to an operatable condition.

If the CPU 110 discriminates that the prescribed time has been passed since the toner began to be fed to the developing device 6 at step S16, there is a possibility that something abnormal has occurred. Therefore, the display that the toner is being fed is erased) step S25), and the opening cover discriminating switch 203 discriminates whether the opening cover 201 is closed (step S26). If the opening cover 201 is opened, there is a possibility that the toner was not fed to the developing device 6 because the user opened the opening cover 201 by mistake while the toner was being fed to the developing device 6 at step S14, thereby stopping the motor 81. Therefore, in order to close the opening cover 201 so as to feed the toner to the developing device 6 again, after the copying operation is interrupted (step S27), the program is returned to step S13.

On the other hand, if the opening cover 201 is closed, the CPU 110 discriminates that something abnormal has occurred, so that the display unit 124 displays that something abnormal occurs (step S28), and the abnormal flag is set (step S29). The copying machine is stopped (step S30), and thus the program is completed. In this case, the copying machine should be repaired by a repairman. After repair, the abnormal flag is reset.

If the toner density detector 102 detects that the toner density $\Gamma$ is at between the toner value $\beta$ and the control reference toner value $\alpha$ ($\beta\leqq\Gamma\leqq\alpha$) at step S10, the toner begins to be fed to the developing device 6 (step S31). In order to feed the toner to the developing device 6, the motors 81, 82, and 83 are driven so as to rotate the rotator 60, and the spiral rollers 46, 22, and 24. In this case, if the opening cover 201 is opened by mistake, the motor 81 cannot be driven. However, in this case, since the toner density is at the toner value $\beta$ or above, it is considered that the toner is not supplied to the toner container 32. Therefore, the CPU 110 dies not discriminate whether the opening cover 201 is opened so that the toner may be fed to the developing device 6. However, it is also possible to detect whether the opening cover 201 is opened as steps S12 through S14. In such a case, if the CPU 110 discriminates that the opening cover 201 is opened, the display unit 124 displays that the opening cover 201 should be closed.

While the toner is being fed to the developing device 6 at step S31, the copying operation is performed normally. If the copying operation of all the sheets to be copied has not been completed (step S32), the program is returned to step S5 where one of the remaining sheets to be copied is copied. On the other hand, if the copying operation of all the sheets to be copied has been completed (step S32), the program is returned to step S1.

If the toner density detector 102 detects that the toner value $\Gamma$ is at above the control reference toner value $\alpha$ ($\Gamma > \alpha$) at step S10, the CPU 110 discriminates whether the toner is being fed to the developing device 6 (step S33). If the toner is being fed to the developing device 6 (step S33), the feed of the toner is stopped (step S34), and thus the program is completed. If the copying operation of all the sheets to be copied has not been completed (step S32), the program is returned to step S5 where one of the remaining sheets to be copied is copied. On the other hand, if the copying operation of all the sheets to e copied has been completed (step S32), the program is returned to step S1.

If the toner is not being fed to the developing device 6 at step S33, the program proceeds to step S32 where the CPU 110 discriminates whether the copying operation of all the sheets to be copied has been completed. If the copying operation of all the sheets to be copied has not been completed, the program is returned to step S5 where one of the remaining sheets to be copied is copied. On the other hand, if the copying operation of all the sheets to be copied has been completed (step S32), the program is returned to step S1.

According to the present embodiment, if the opening cover 201 is opened, the rotator 60 is prevented from driving, and thus the toner cartridge 33 can be exchanged for the new cartridge without a possibility that the toner will be dispersed around the copying machine. Even if the opening cover 201 is opened, the copying operation is not interrupted nor prevented automatically, thereby not reducing efficiency of the copying operation.

In the present embodiment, the toner is supplied to the toner container 32 by attaching the toner cartridge 33 to the toner container 32. However, the present invention can also be applied to a copying machine in which a toner is directly supplied to a toner container by using a toner bottle, etc.

The present invention is described referring to the copying machine in which the toner is fed from the toner container 32 to the developing device 6 by the toner feed device 40 provided therebetween. However, the present invention can also be applied to a copying machine in which a toner is fed from a toner container to a developing device by using only a rotator provided in the toner container.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image forming apparatus, comprising:

a toner container for stocking a toner to be fed to a developing device;

compartment means in a body of the image forming apparatus for receiving and supporting a toner cartridge in operative relationship to said toner container for supplying toner to said toner container;

a rotator provided in the toner container, for discharging the toner from the toner container;

an opening provided in said body of the image forming apparatus for inserting a toner cartridge through said opening for supplying the toner to the toner container;

an openable opening cover for covering the opening;

an opening cover detector for detecting whether the opening cover is open; and control means for preventing the rotator from rotating when the opening cover detector detects that the opening cover is open.

2. An image forming apparatus according to claim 1, further comprising toner feed means for feeding the toner discharged from the toner container by the rotator to the developing device.

3. An image forming apparatus according to claim 2, further comprising:

a toner volume detector for detecting whether a toner volume in the toner container is reduced to a prescribed value; and a toner density detector for detecting a toner density in the developing device;

wherein the control means controls the toner feed means in accordance with signals from the toner volume detector, the toner density detector, and the opening cover detector.

4. An image forming apparatus according to claim 3, wherein the control means drives the rotator and the toner feed means when the toner volume detector detects that the toner volume is at the prescribed value or above, the toner density detector detects that the toner density is below a prescribed value, and the opening cover detector detects that the opening cover is closed.

5. An image forming apparatus, comprising:

a toner container for stocking a toner to be fed to a developing device;

a rotator provided in the toner container, for discharging the toner from the toner container;

an opening provided in a body of the image forming apparatus, for inserting said toner cartridge for supplying the toner to the toner container;

an openable opening cover for covering the opening;

an opening cover detector for detecting whether the opening cover is open;

control means for preventing the rotator from rotating when the opening cover detector detects that the opening cover is open;

toner feed means for feeding the toner discharged from the toner container by the rotator to the developing device;

a toner volume detector for detecting whether a toner volume in the toner container is reduced to a prescribed value;

a toner density detector for detecting a toner density in the developing device;

wherein the control means controls the toner feed means in accordance with signals from the toner volume detector, the toner density detector, and the opening cover detector, wherein the control means also drives the rotator and the toner feed means when the toner volume detector detects that the toner volume is at or above the prescribed value, the toner density detector detects that the toner density is below a prescribed value, the toner density detector detects that the toner density is below a prescribed value, and the opening cover detector detects that the opening cover is closed; and wherein the control means interrupts an image forming operation if the toner density detector detects that the toner density is still below the prescribed value when a prescribed time has passed since driving of the rotator and the toner feed means.

6. An image forming apparatus according to claim 5, wherein the control means discriminates whether the opening cover is opened when the toner density detector detects that the toner density is still at below the prescribed value even when the prescribed time has been passed since the drive of the rotator and the toner feed means.

7. An image forming apparatus according to claim 6, wherein the control means displays that the opening cover should be closed when the opening cover detector detects that the opening cover is open, and the control means drives the rotator and the toner feed means after the opening cover detector detects that the opening cover is closed.

8. An image forming apparatus, comprising:

a toner container for stocking a toner to be fed to a developing device;

a rotator provided in the toner container, for discharging the toner from the toner container;

an opening provided in a body of the image forming apparatus, for inserting said toner cartridge for supplying the toner to the toner container;

an openable opening cover for covering the opening;

an opening cover detector for detecting whether the opening cover is open;

control means for preventing the rotator from rotating when the opening cover detector detects that the opening cover is open;

toner feed means for feeding the toner discharged from the toner container by the rotator to the developing device;

a toner volume detector for detecting whether a toner volume in the toner container is reduced to a prescribed value;

a toner density detector for detecting a toner density in the developing device;

wherein the control means controls the toner feed means in accordance with signals from the toner volume detector, the toner density detector, and the opening cover detector; and wherein the control means displays that the opening cover should be closed when the toner volume detector detects that the toner volume is at the prescribed value or above, the toner density detector detects that the toner density is below a prescribed value, and the opening cover detector detects that the opening cover is opened.

9. An image forming apparatus according to claim 8, wherein the control means drives the rotator and the toner feed means when the opening cover detector detects that the opening cover is closed after the control means displays that the opening cover should be closed.

10. An image forming apparatus according to claim 9, wherein the control means interrupts an image forming operation if the toner density detector detects that the toner density is still below the prescribed value even when a prescribed time has passed since the drive of the rotator and the toner feed means.

11. An image forming apparatus according to claim 10, wherein the control means discriminates whether the opening cover is open if the toner density detector detects that the toner density is still below the prescribed value even then the prescribed time has passed since the drive of the rotator and the toner feed means.

12. An image forming apparatus according to claim 11, wherein the control means displays that the opening cover should be closed when the opening cover detector detects that the opening cover is opened, and the control means drives the rotator and the toner feed means when the opening cover detector detects that the opening cover is closed.

* * * * *

UNITED STATES PATENT AND TRADEMARK OFFICE

CERTIFICATE OF CORRECTION

PATENT NO. : 5,298,951

DATED : March 29, 1994

INVENTOR(S) : Masami Kai

It is certified that error appears in the above-identified patent and that said Letters Patent is hereby corrected as shown below:

Claim 5, column 10, lines 66-67, delete "the toner density detector detects that the toner density is below a prescribed value,"

claim 11, column 12, line 32, change "even then" to —even when—.

Signed and Sealed this

Twenty-seventh Day of September, 1994

*Attest:*

Bruce Lehman

BRUCE LEHMAN

*Attesting Officer*

*Commissioner of Patents and Trademarks*